US007322222B2

(12) United States Patent
Kodaka et al.

(10) Patent No.: US 7,322,222 B2
(45) Date of Patent: Jan. 29, 2008

(54) METHOD OF PRESS MOLDING AND MOLDING DEVICE

(75) Inventors: Hidemoto Kodaka, Tokyo (JP); Naohisa Adachi, Zama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 11/313,659

(22) Filed: Dec. 22, 2005

(65) Prior Publication Data

US 2006/0137422 A1 Jun. 29, 2006

(30) Foreign Application Priority Data

Dec. 27, 2004 (JP) ..... 2004-376183
Aug. 30, 2005 (JP) ..... 2005-248915

(51) Int. Cl.
*B21D 22/22* (2006.01)

(52) U.S. Cl. ..... 72/350; 72/309

(58) Field of Classification Search ..... 72/350, 72/351, 309, 358
See application file for complete search history.

(56) References Cited

U.S. PATENT DOCUMENTS 3,664,172 A * 5/1972 Cvacho ..... 72/350
4,096,729 A * 6/1978 Dupler ..... 72/350
5,014,537 A * 5/1991 Nine ..... 72/350
5,701,777 A * 12/1997 Yamanaka et al. ..... 72/350
6,196,043 B1 * 3/2001 Ehardt ..... 72/350

FOREIGN PATENT DOCUMENTS

| | | | |
|---|---|---|---|
| DE | 195 04 264 A1 | | 8/1996 |
| DE | 103 22 272 A1 | | 12/2004 |
| JP | 56160836 A | * | 12/1981 |
| JP | 63-177926 A | | 7/1988 |
| JP | 03066423 A | * | 3/1991 |
| JP | 10-5889 A | | 1/1998 |
| JP | 2003-164922 (A) | | 6/2003 |

* cited by examiner

*Primary Examiner*—Derris H. Banks
*Assistant Examiner*—Debra M Wolfe
(74) *Attorney, Agent, or Firm*—Foley & Lardner LLP

(57) ABSTRACT

The sheet metal blank to be press molded comprises a product section (W1) and a grip section (W2) disposed on the periphery of the product section (W1). The press molding device performs press molding on the product section (W1) while gripping the grip section (W2) with the upper die (11) and the lower die (12). A bead (W3) comprising alternately disposed indented sections (A, C) and protruding sections (B, D) is press molded beforehand on the grip section (W2) by meshing the indented corners (6, 8) and protruding corners (3, 5) formed on the lower die (12) with corresponding indented corners (7, 9) and protruding corners (2, 4) formed on the upper die (11). Consequently a preferable constraining force without reducing the radius of the indented sections (A, C) and protruding sections (B, D), thereby protecting the galvanized surface of the sheet blank from chipping.

10 Claims, 6 Drawing Sheets

METHOD OF PRESS MOLDING AND MOLDING DEVICE

FIELD OF THE INVENTION

This invention relates to regulating a blank constraining force which is promoted by a bead formed on the blank when press molding sheet metal.

BACKGROUND OF THE INVENTION

Press molding of sheet metal is performed by driving a punch against the sheet metal while gripping a grip section that is located on the outer periphery of the sheet metal by upper and lower dies of a vertical forming die. After molding a product portion which is located inner side of the ring shaped grip section, a pressed product is obtained by cutting the grip section from the periphery of the product portion.

During press molding, and in particular during draw molding or draw forming, peripheral sheet metal displaces towards the product portion as a result of the pressing process. This phenomenon is termed blank inflow. It is necessary to retain the grip section in order to control the amount of inflow. An appropriate gripping force is applied by the forming die onto the grip section in order to counteract a detaching force towards the center which acts on the sheet metal gripped by the upper and lower dies.

The gripping force on the grip section applied by the forming die is created by forming a tongue and groove section termed a bead on the grip section. The bead is formed using a bead molding section provided on upper and lower dies of the vertical forming die. Pressing operations are simultaneously or thereafter performed on the product portion using the punch with the vertical forming die gripping the bead.

JP10-005889A published by the Japan Patent Office in 1998 proposes a method of forming the bead on the grip section of the sheet metal. According to this method, a bead being trapezoid in cross section and having rounded corners is formed on the grip section. In this prior art method, the tongue section and the groove section are formed as a bead on the grip section by the upper and lower dies of the forming die. Further, when the vertical forming die molds and retains the bead, it is arranged such that only the tongue section of the forming die abuts with the metal plate. Sections other than the tongue section including the groove section of the forming die do not come into contact with the sheet metal.

As a result, even when the clearance between the upper and lower dies of the vertical forming die is not uniform as a result of, deviation of the core, for example, a stable resistance force which acts on the blank when it surmounts the bead or stable blank inflow amount is produced without the necessity to regulate the clearance.

SUMMARY OF THE INVENTION

As disclosed in the prior art method above, the resistance force acting on the sheet metal when it surmounts the bead during draw molding can be controlled by the shape of the bead. However the shape of the bead may produce the following problems.

Specifically, when the radius of curvature of the bead is reduced in order to increase the blank constraining force, the sheet metal surface tends to be scratched by the curved section of the bead. When the sheet metal with a galvanized surface surmounts a bead with a small radius of curvature, the galvanized section tends to be chipped. Powder produced by the chipped galvanized layer adheres to the forming die or the sheet metal and causes surface defects after molding.

On the other hand, when the radius of curvature of the bead is increased in order to prevent chipping of the galvanized section, there is an adverse effect on the creation of a preferred blank constraining force of the bead.

It is possible to provide two lines of bead in order to obtain a preferred blank constraining force, but the entire length of the bead will become large as a result, so the cost of press molding will increase.

It is therefore an object of this invention to produce a preferred constraining force on bead without resulting in an increase in the length of the bead or chipping of the galvanized surface of the metal plate.

In order to achieve the above object, this invention provides a method of press molding of sheet blank. The sheet blank comprises a product section and a grip section surrounding the product section. The method comprises press molding a bead comprising grooves and tongues disposed alternately onto the grip section by using the meshing of an upper die and a lower die.

The upper die is provided with alternately disposed protruding corners and indented corners and the lower die is provided with alternately disposed protruding corners and indented corners so as to mesh with the upper die. The method further comprises pressing molding the product section while gripping the bead with the upper die and lower die in mesh.

This invention also provides a press molding device for press molding of the sheet blank. The device comprises an upper die being provided with alternately disposed protruding corners and indented corners; and a lower die being provided with alternately disposed protruding corners and indented corners so as to mesh with the upper die. The device is configured to press mold a bead comprising grooves and tongues disposed alternately onto the grip section by using the meshing of the upper die and the lower die; and press mold the product section while gripping the bead with the upper die and the lower die in mesh.

The details as well as other features and advantages of this invention are set forth in the remainder of the specification and are shown in the accompanying drawings.

DESCRIPTION OF THE PREFERRED EMBODIMENTS

Figure 1:
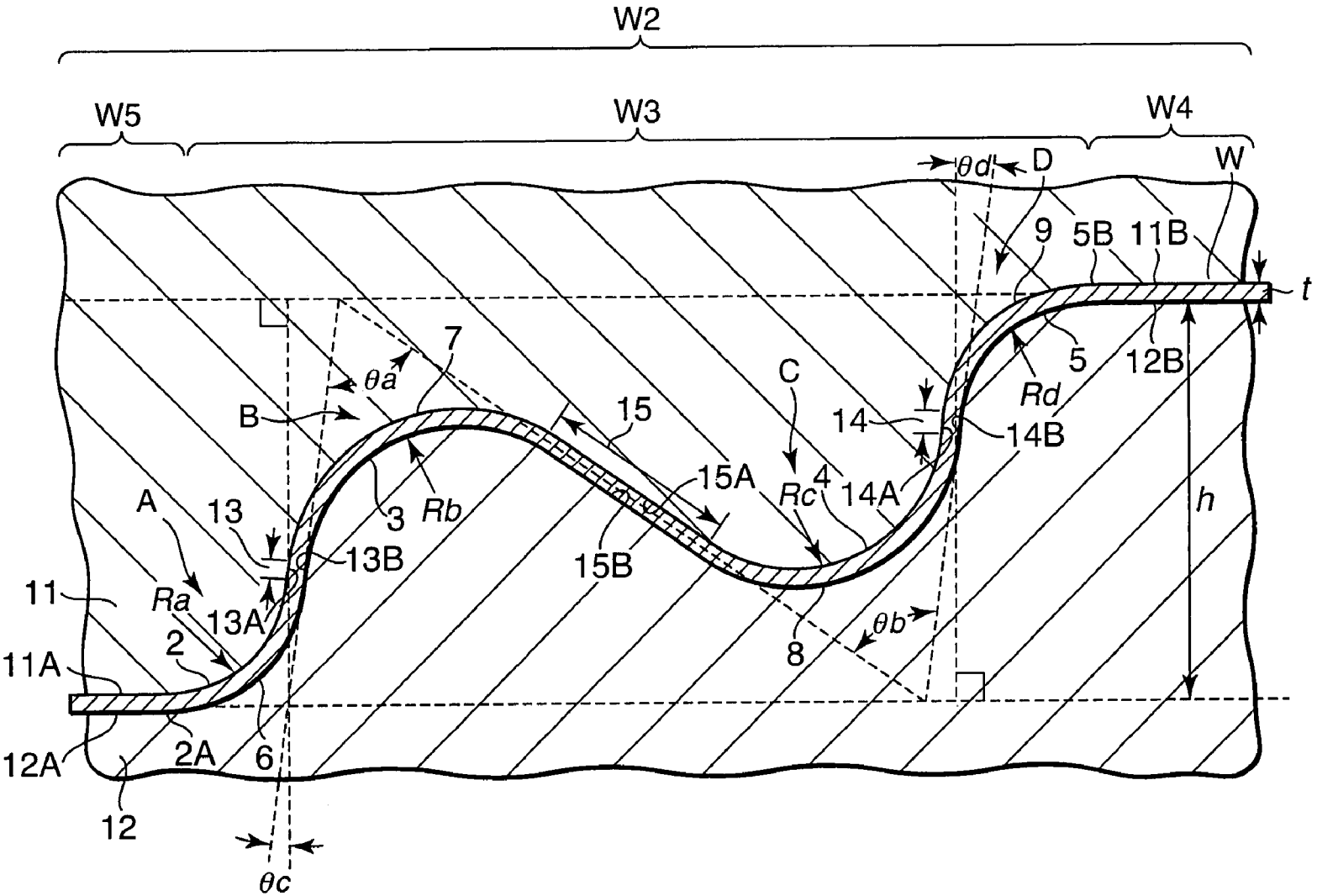
FIG. 1 is a cross-sectional view of a grip section provided on sheet metal which is molded by a press forming die according to this invention.

Referring to FIG. 1 of the drawings, a forming die according to this invention comprises an upper die 11 and a lower die 12. In this figure, when the upper die 11 and the lower die 12 are mold clamped, the dies 11 and 12 grip a grip section W2 of a blank W of sheet metal. The upper mold 11 and the lower mold 12 are opposed with a clearance therebetween corresponding to the thickness t of the blank W. The forming die is a die used in press molding an engine hood of a vehicle.

Figure 7:
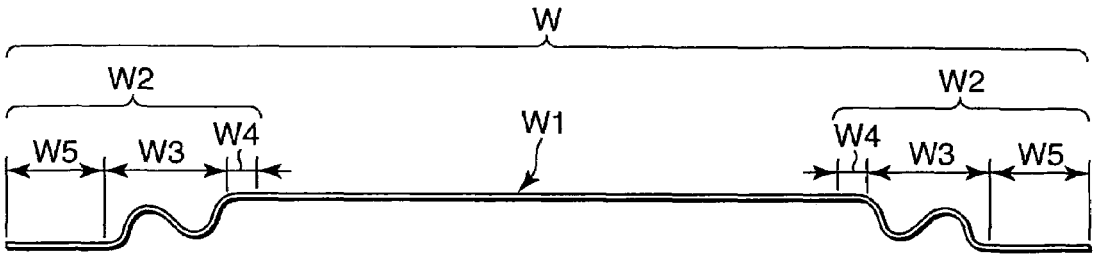
FIG. 7 is a cross-sectional view of sheet metal blank for an engine hood before draw molding according to this invention.

Referring now to FIG. 7, the blank W comprises a product section W1 which is the material to be press molded and a grip section W2 disposed on the outer periphery of the product section W1. FIG. 1 corresponds to an enlarged view of the grip section W2 of the left side of FIG. 7.

In FIG. 1 therefore, the product section W1 is disposed on the right side of the figure and the left side of the figure corresponds to the outer periphery of the blank W.

The grip section W2 comprises bead W3 and horizontal sections W4 and W5 disposed on either side of the bead W3. The bead W3 comprises a groove A, a tongue B, a groove C and a tongue D provided alternately in order to form two interconnected letters S. The groove A and the tongue B are connected by a straight section 13. The tongue B and the groove C are connected by a straight section 15. The groove section C and the tongue D are connected by a straight section 14. The straight section 15 is longer than the straight section 13 and the straight section 14 on either side.

In order to form the grip section W2 with a shape as described above on the blank W, the upper die 11 of the forming die is provided with a horizontal face 11A pressing the horizontal section W5, a first protruding corner 2 molding the grooved section A, a second indented corner 7 molding the tongue section B, a third tongue corner 4 forming a grooved section C, a fourth grooved corner 9 forming a tongue section D, and a horizontal face 11B pressing the horizontal section W4.

The lower die 12 of the forming die comprises a horizontal face 12A pressing the horizontal section W5, a first indented corner 6 molding the grooved section A, a second protruding corner 3 molding the tongue section B, a third indented corner 8 forming a grooved section C, a fourth protruding corner 5 forming a tongue section D, and a horizontal face 12B pressing the horizontal section W4. The height from the horizontal face 12A disposed at the lowest position of the lower die 12 to the horizontal face 12B disposed at the highest position is defined as "h". The height from the horizontal face 11A of the upper die 11 to the horizontal face 11B is also defined as "h". The bead W3 is therefore formed within the range of the height h.

A flat face 13A corresponding to the straight section 13 of the blank W is formed between the first protruding corner 2 and the second indented corner 7 of the upper die 11. A flat face 15A corresponding to the straight section 15 of the blank W is formed between the second indented corner 7 and the third protruding corner 4. A flat face 14A corresponding to the straight section 14 of the blank W is formed between the third protruding corner 4 and the fourth indented corner 9.

In the same manner, a flat face 13B corresponding to the straight section 13 of the blank W is formed between the first indented corner 6 and the second protruding corner 3 of the lower die 12. A flat face 15B corresponding to the straight section 15 of the blank W is formed, between the second protruding corner 3 and the third indented corner 8. A flat face 14B corresponding to the straight section 14 of the blank W is formed between the third indented corner 8 and the fourth protruding corner 5.

The slope of the straight section 13 is equal to the slope of the flat faces 13A, 13B. The slope of the straight section 14 is equal to the slope of the flat faces 14A, 14B. The slope of the straight section 15 is equal to the slope of the flat faces 15A, 15B.

The radius of the first protruding corner 2 the radius of the second protruding corner 3, the radius of the third protruding corner 4, and the radius of the fourth protruding corner 5 are respectively designated as Ra, Rb, Rc and Rd.

The angle of intersection of the flat face 13B and the horizontal face 12A of the lower die 12 is greater than or equal to 90 degrees. The angle of intersection of the flat face 14B and the horizontal face 12B of the lower die 12 is also greater than or equal to 90 degrees.

In the description hereafter, the angle subtended by the slope of the straight section 13 and the vertical line in the figure is defined as θc. The flat faces 13A, 13B corresponding to the straight section 13 have the same slope as the straight section 13. The angle subtended by the slope of the straight section 14 and the vertical line in the figure is defined as θd. The angle θc is also used as the value expressing the angle subtended by the first protruding corner 2. The angle θd is also used as the value expressing the angle subtended by the fourth protruding corner 5.

In the second protruding corner 3 of the lower die 12, the angle of intersection θa of the flat face 13B corresponding to the straight section 13 and the flat face 15B corresponding to the straight section 15 is smaller than 90 degrees. In the third indented corner 8 of the lower die 12, the angle of intersection θb of the flat face 15B corresponding to the straight section 15 and the flat face 14B corresponding to the straight section 14 is also smaller than 90 degrees.

Figure 2B:
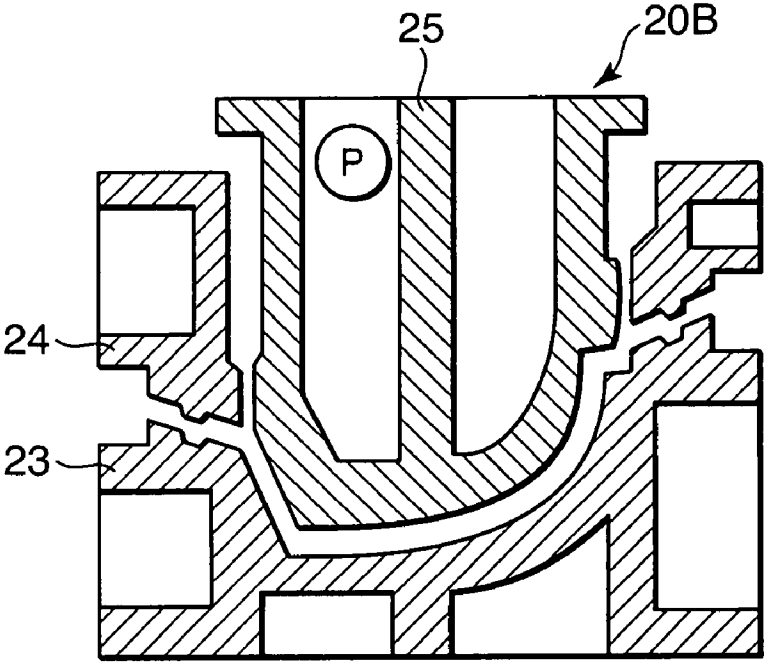
FIGS. 2A and 2B are schematic cross-sectional views of the press molding die.
Figure 2A:
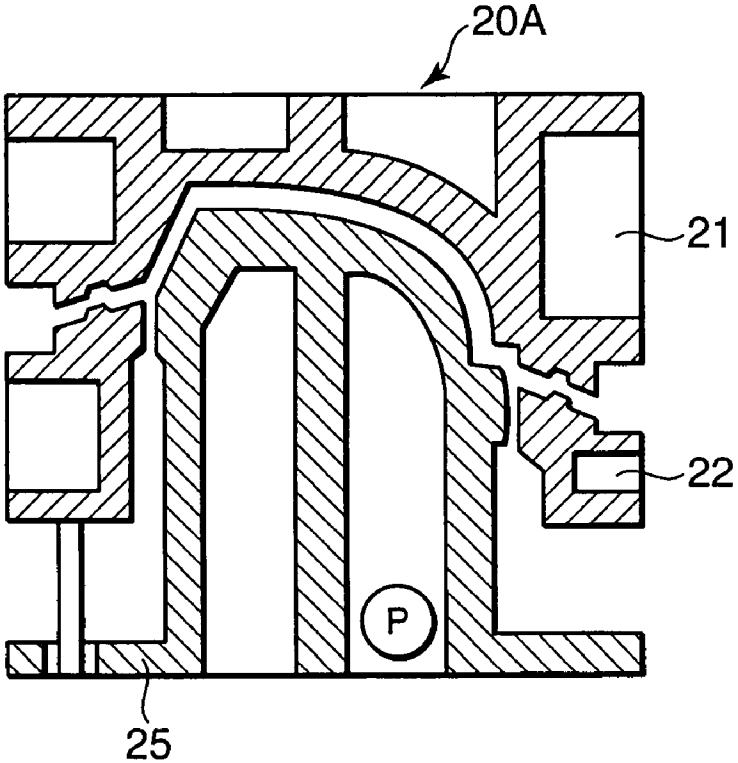

The upper die 11 and the lower die 12 described above are adapted for use with a single-action draw forming die 20A shown in FIG. 2A or a double-action draw forming die 20B shown in FIG. 2B. In other words, the single-action draw forming die 20A in FIG. 2A uses the upper die 11 as an upper die 21 and the lower die 12 as a cushion ring 22. The double-action draw forming die 20B in FIG. 2B uses the upper die 11 as a blank holder 24 and the lower die 12 as a lower die 23. In FIGS. 2A and 2B, the member 25 designates a punch.

The process of press forming a sheet metal blank W using a pressing machine comprising an upper die 11 and a lower die 12 as above will be described hereafter.

Firstly the blank W is placed at a predetermined position on the lower die 12. At this time, the horizontal section W4 of the blank W is supported by the highest horizontal face 12B of the lower die 12 and the horizontal face 12A, the first indented corner 6, the second protruding corner 3, the third indented corner 8 and the fourth protruding corner 5 of the lower die 12 are covered by the grip section W2 of the blank W which is not yet molded.

Then the upper die 11 is depressed downwardly until the horizontal face 11A becomes in contact with the horizontal section W5 of the blank W. When the upper die 11 is pressed further downwardly from this position, the horizontal section W5 presses downwardly on the horizontal face 11A. Thereafter the first protruding corner 2 and the third protruding corner 4 of the upper die 11 and the second protruding corner 3 and the fourth protruding corner 5 of the lower die 12 respectively abut with the blank W and create a bending deformation in the blank W.

Finally, the molding of the bead W3 is completed by depressing the upper die 11 to the state as shown in FIG. 1. In this manner, the molded bead W3 is alternatively bent and deformed in opposite directions by the plurality of protruding corners 2-5 formed alternatively on the upper die 11 and the lower die 12.

deformation, but at the same time it surmounts the corner 2-5 towards the production section W1 or right hand side of FIG. 1 due to the dragging force acting thereon.

Figure 4:
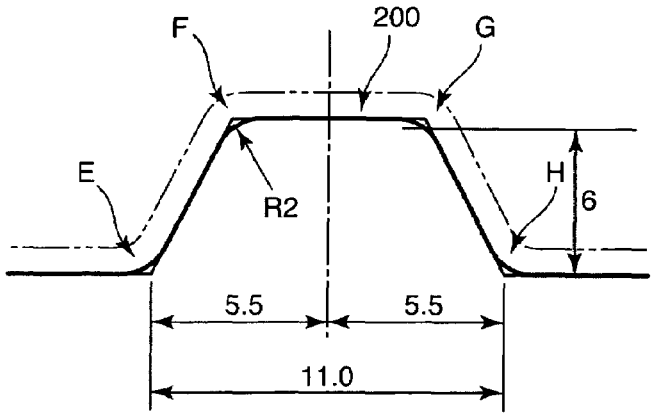
PRIOR ART FIG. 4
FIG. 4 is a cross-sectional view of a bead forming portion of a vertical forming die according to the comparative example showing the dimensions and shape thereof.

The inventors have compared the molding of an engine hood using the blank W in which bead W3 is formed and retained by the upper die 11 and the lower die 12 according to this invention with the molding of an engine hood using a blank according to a comparative example which has a bead 200 formed and retained according to the prior art. The shape and dimensions of the bead 200 are shown in FIG. 4.

Figure 3B:
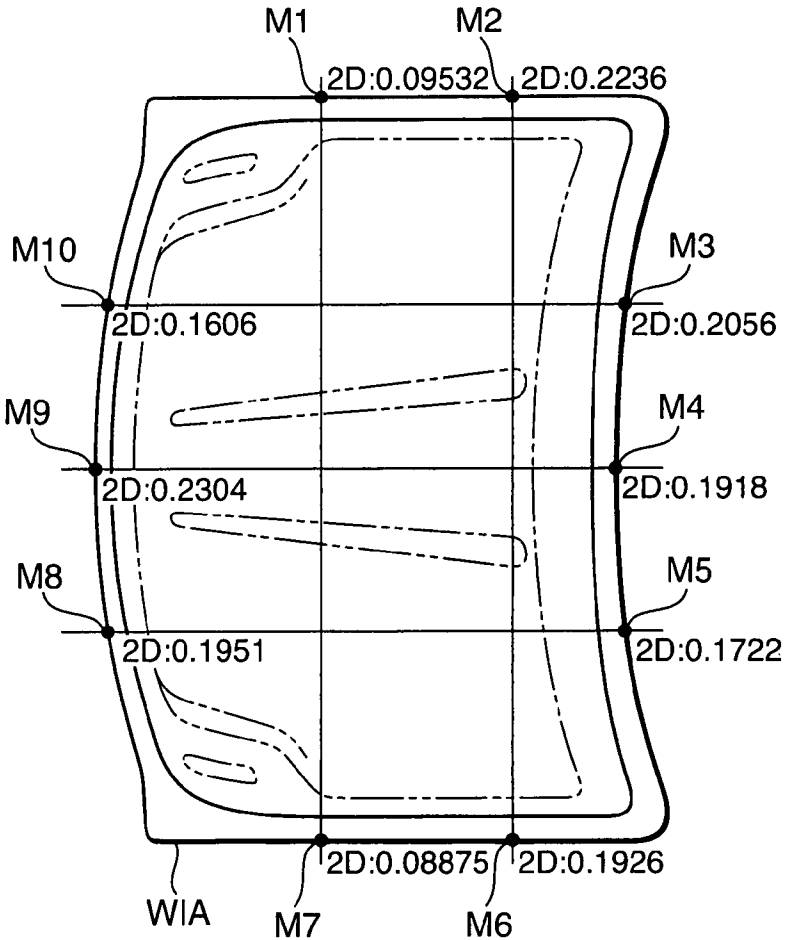
FIGS. 3A and 3B are plan views of an engine hood for a vehicle being an example of a press molded product for the purpose of defining measure points of the amount of blank inflow when a grip section according to this invention is used and when a grip section being a comparative example from the prior art is used.
Figure 3A:
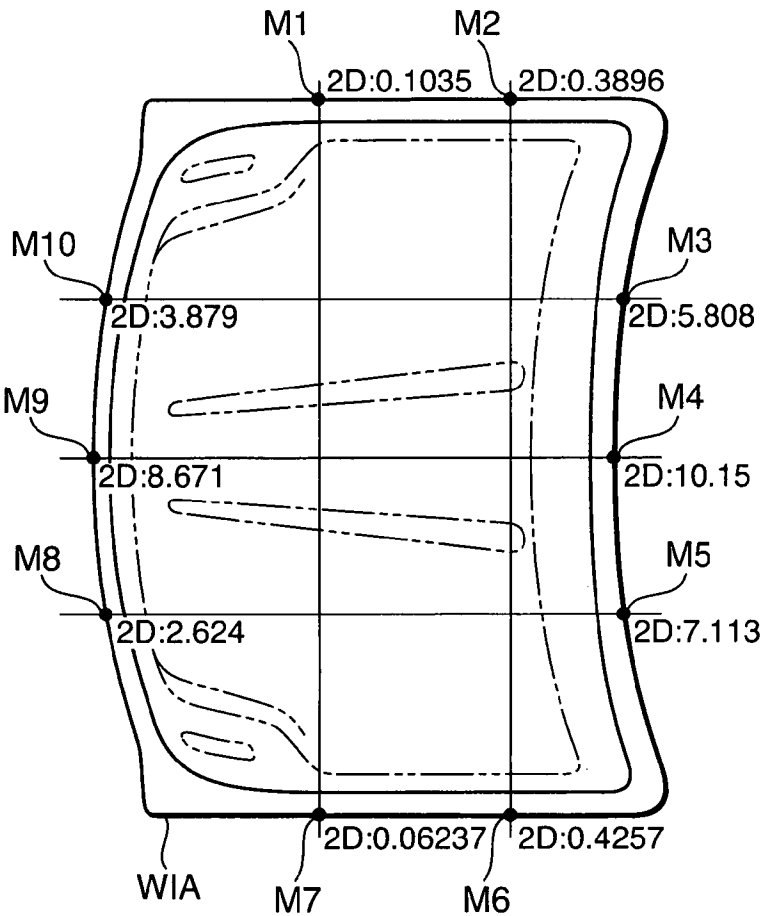

Ten measurement points M1-M10 were provided in order to measure the inflow amount of the respective blanks as shown in FIGS. 3A and 3B.

The measurement results in both cases with respect to the ten measurement points M1-M10 are shown in TABLE-1.

TABLE 1

| MEASURE POINT | M1 | M2 | M3 | M4 | M5 | M6 | M7 | M8 | M9 | M10 |
|---|---|---|---|---|---|---|---|---|---|---|
| COMPARATIVE EXAMPLE | 0.104 | 0.390 | 5.808 | 10.150 | 7.113 | 0.426 | 0.082 | 2.624 | 8.671 | 3.879 |
| THIS INVENTION | 0.096 | 0.224 | 0.206 | 0.192 | 0.172 | 0.193 | 0.089 | 0.195 | 0.230 | 0.161 |

Unit: mm

In other words, the bead W3 comprises a first deformed section wound onto the fourth protruding corner 5 positioned on the innermost periphery, a second deformed section wound onto the third protruding corner 4 on the outer side of the first deformed section, a third deformed section wound onto the second protruding corner 3 on the outer side of the second deformed section, and a deformed section wound onto the first protruding corner 2 on the outermost periphery.

The clearance between the indented corners 6-9 and the corresponding indented corner 2-5 does not always have to equal the plate thickness t of the blank W. For example, even if the clearance is greater than the plate thickness t, there is a bending deformation wound onto each protruding corner 2-5. As a result, the bead W3 is restricted by the upper die 11 and the lower die 12. It is even preferred that the clearance is set to be slightly greater than the plate thickness t.

The bead W3 on the right side of the blank W shown in FIG. 7 is restricted in the same manner by the upper die 11 and the lower die 12.

Figure 8:
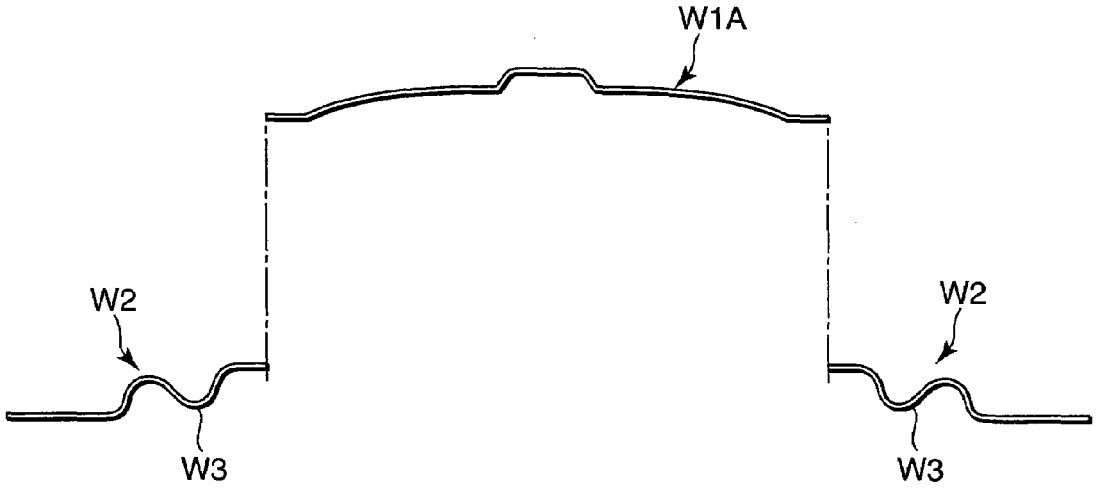
FIG. 8 is a cross-sectional view of an engine hood with the grip section detached by trimming according to this invention.
Figure 9:
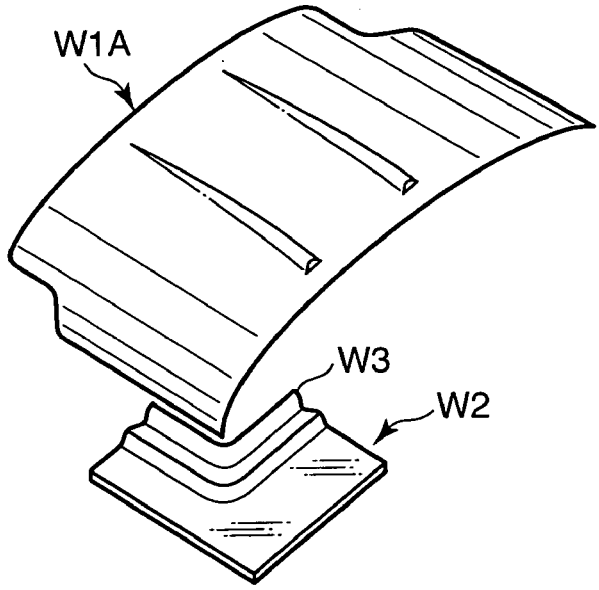
FIG. 9 is a perspective view of a corner section of the grip section detached from the engine hood by trimming.
Figure 10:
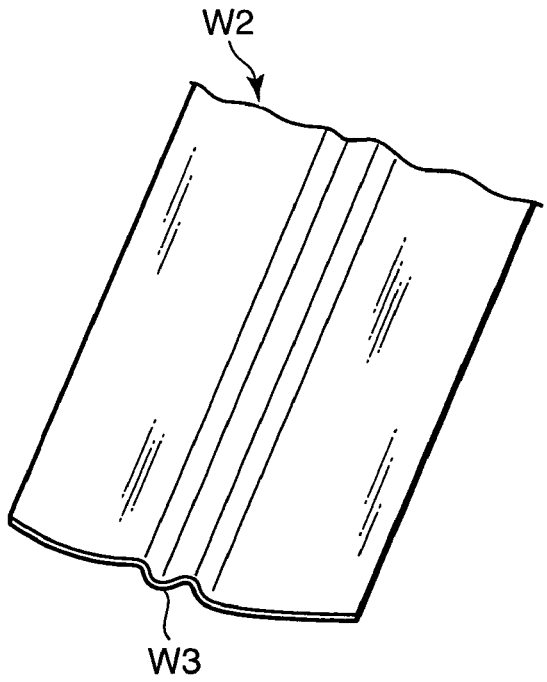
FIG. 10 is a perspective view of a straight section of the grip section detached by trimming.

In this manner, when the bead W3 on the outer periphery of the product section W1 is restricted by the upper die 11 and the lower die 12, the product section is pressed using the punch 25 in order to obtain a molded section W1A for an engine hood as shown in FIG. 8. FIG. 8 shows the molded section W1A after the grip section W2 is detached. FIG. 9 shows the shape of the corner section of the grip section W2 after cutting. FIG. 10 shows the shape of the straight section of the grip section W2 at the same time.

When the pressing operation is performed on the product section W1, the sheet metal blank W is dragged towards the center. In contrast, at the grip section W2 surrounding the product section W1, the blank W wound on the protruding corner 2-5 is under the constraining force due to bending As shown in TABLE-1, at almost all measurement points, the inflow amount of the blank during use of blank W according to this invention in which bead W3 is formed and retained by the upper die 11 and the lower die 12 is lower than the inflow amount of the blank of the comparative example in which bead 200 which has the shape and dimensions as shown in FIG. 4 is formed and retained. In other words, it has been shown that blank W in which bead W3 is formed and retained by the upper die 11 and the lower die 12 according to this invention has a greater constraining force. When a dragging force greater than the constraining force of the blank W is applied to the blank W, the blank W is displaced. Consequently it is possible to view the blank constraining force as a blank dragging force.

Figure 5:
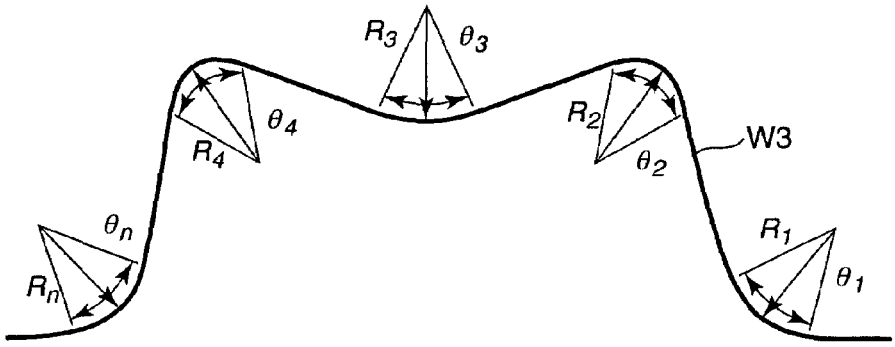
FIG. 5 is a diagram showing a computational model of the blank constraining force of a bead formed by the forming die according to this invention.

The respective constraining forces on the bead W3 and the bead 200 can be theoretically calculated from the angle of bend θ1-θn and the respective radii R1-Rn of the protruding corners in the model shown in FIG. 5. The calculation result for the constraining force of the bead W3 is 415 newtons/millimeters (N/mm) and the calculation result for the constraining force of the bead 200 is 363 (N/mm).

In this embodiment, the groove section A, the tongue section B, the groove section C, the tongue section D are alternately formed on the bead W3. The bead 200 of the prior art as shown in FIG. 4 is formed in the sequence of the groove section E, the tongue section F, the groove section G, the tongue section H. In other words, the bead 200 does not entail the alternate formation of the indented and protruding sections. This invention uses the upper die 11 and the lower die 12 to form bead W3 with alternating groove and tongue sections. During pressing of the product section W1, the upper die 11 and the lower die 12 retain the bead W3. Thus it is possible to obtain a high constraining force with low blank inflow.

The press processing of the engine hood W1A as shown in FIGS. 3A and 3B is a draw forming process which molds the entire shape of the product and which includes draw processing, bulging processing and bending processing.

Figure 6:
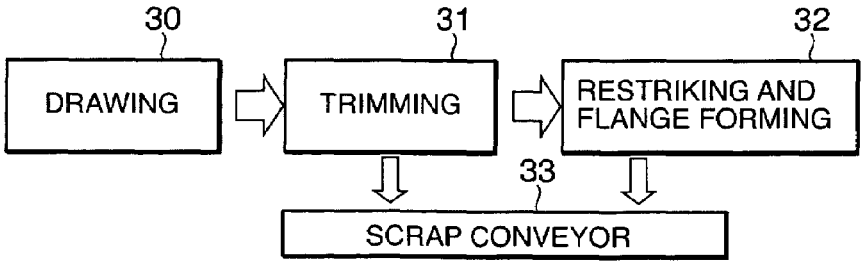
FIG. 6 is a block diagram showing the steps in press molding according to this invention.

Referring to FIG. 6, this type of press molded product is completed by a trimming step 31 and a re-strike step 32 following a draw forming step 30 which corresponds to the above draw forming process. In the trimming step 31, the outer periphery not used in the product is cut off after the draw step 30 as shown in FIG. 8. In the re-strike step 32, sections not completely molded in the draw forming step 30 or small curved sections including flange molds on the edge are molded into a final shape. The completed product comprising the engine hood W1A is sub-assembled into the engine hood and transported along the assembly line where it is combined with the inner hood which is a strengthening member in order to assemble the engine hood. Furthermore scrap metal resulting from the trimming step 31 or the re-strike step 32 is transported on a conveyer 33.

In the draw forming step 30, when the constraining force on the bead W3 is excessive, the inflow amount of the blank becomes excessively small. Consequently there is the possibility of breakage of the horizontal section W4 on the inner side of the grip section W2 or breakage of the product section W1. Conversely when the constraining force is insufficient, the inflow amount of the blank becomes excessive and as a result pressure creasing tends to result on the grip section W2.

Examination of markings on the scrap formed by the grip section W2 during the trimming step 31 demonstrates the behavior of the blank during the drawing step 30. Such markings include those produced by sliding or grinding of the upper die 11 and the bead W3 or sliding and grinding of the lower die 12 and the bead W3. Examination of the scrap formed from the grip section W2 shows that the state produced in the bead W3 during the trimming step 31 extends along the entire periphery. Thus it is possible to determine whether or not the pressing conditions produced by the upper die 11 and the lower die 12 during the draw forming step 30 are suitable.

The inventors have used a simulation in order to analyze the relationship between the constraining force on the bead W3 and the radius Ra-Rd and the angles θa-θd with respect to the first protruding corner 2 and third protruding corner 4 formed in the upper die 11 and the second protruding corner 3 and fourth protruding corner 5 formed in the lower die 12. The results of the simulation are shown in TABLE-2 through TABLE-5.

TABLE 2

| | | | | | | | | | | | |
|---|---|---|---|---|---|---|---|---|---|---|---|
| θa (degree) | 30.0 | 40.0 | 50.0 | 60.0 | 70.0 | 80.0 | 90.0 | 100.0 | 110.0 | 120.0 | 130.0 |
| θb (degree) | 30.0 | 40.0 | 50.0 | 60.0 | 70.0 | 80.0 | 90.0 | 100.0 | 110.0 | 120.0 | 130.0 |
| θc (degree) | 6.0 | 6.0 | 6.0 | 6.0 | 6.0 | 6.0 | 6.0 | 6.0 | 6.0 | 6.0 | 6.0 |
| θd (degree) | 6.0 | 6.0 | 6.0 | 6.0 | 6.0 | 6.0 | 6.0 | 6.0 | 6.0 | 6.0 | 6.0 |
| Ra (mm) | 3.0 | 3.0 | 3.0 | 3.0 | 3.0 | 3.0 | 3.0 | 3.0 | 3.0 | 3.0 | 3.0 |
| Rb (mm) | 3.0 | 3.0 | 3.0 | 3.0 | 3.0 | 3.0 | 3.0 | 3.0 | 3.0 | 3.0 | 3.0 |
| Rc (mm) | 3.0 | 3.0 | 3.0 | 3.0 | 3.0 | 3.0 | 3.0 | 3.0 | 3.0 | 3.0 | 3.0 |
| Rd (mm) | 3.0 | 3.0 | 3.0 | 3.0 | 3.0 | 3.0 | 3.0 | 3.0 | 3.0 | 3.0 | 3.0 |
| h (mm) | 6.0 | 6.0 | 6.0 | 6.0 | 6.0 | 6.0 | 6.0 | 6.0 | 6.0 | 6.0 | 6.0 |
| BEAD BLANK LENGTH (mm) | −0.7 | 1.0 | 0.5 | 11.8 | 16.0 | 24.5 | 60.2 | −23.3 | −22.3 | −12.6 | −8.9 |
| STRAIGHT SECTION (mm) | −15.8 | −9.2 | −4.5 | −0.2 | 5.2 | 14.6 | 51.4 | −91.0 | −29.0 | −18.2 | −13.5 |
| CONSTRAINING FORCE (N/mm) | 228.8 | 215.3 | 202.7 | 190.7 | 180.0 | 169.8 | 160.3 | 151.4 | 143.2 | 135.5 | 128.2 |

TABLE 3

| | | | | | | | | | | | |
|---|---|---|---|---|---|---|---|---|---|---|---|
| θa (degree) | 80.0 | 80.0 | 80.0 | 80.0 | 80.0 | 80.0 | 80.0 | 80.0 | 80.0 | 80.0 | 80.0 |
| θb (degree) | 80.0 | 80.0 | 80.0 | 80.0 | 80.0 | 80.0 | 80.0 | 80.0 | 80.0 | 80.0 | 80.0 |
| θc (degree) | 6.0 | 6.0 | 6.0 | 6.0 | 6.0 | 6.0 | 6.0 | 6.0 | 6.0 | 6.0 | 6.0 |
| θd (degree) | 6.0 | 6.0 | 6.0 | 6.0 | 6.0 | 6.0 | 6.0 | 6.0 | 6.0 | 6.0 | 6.0 |
| Ra (mm) | 0.0 | 0.5 | 1.0 | 1.5 | 2.0 | 2.5 | 3.0 | 3.5 | 4.0 | 4.5 | 5.0 |
| Rb (mm) | 0.0 | 0.5 | 1.0 | 1.5 | 2.0 | 2.5 | 3.0 | 3.5 | 4.0 | 4.5 | 5.0 |
| Rc (mm) | 0.0 | 0.5 | 1.0 | 1.5 | 2.0 | 2.5 | 3.0 | 3.5 | 4.0 | 4.5 | 5.0 |
| Rd (mm) | 0.0 | 0.5 | 1.0 | 1.5 | 2.0 | 2.5 | 3.0 | 3.5 | 4.0 | 4.5 | 5.0 |
| h (mm) | 6.0 | 6.0 | 6.0 | 6.0 | 6.0 | 6.0 | 6.0 | 6.0 | 6.0 | 6.0 | 6.0 |
| BEAD BLANK LENGTH (mm) | 21.8 | 22.2 | 22.7 | 19.5 | 23.6 | 24.0 | 24.5 | 24.9 | 25.4 | 25.8 | 26.3 |
| STRAIGHT SECTION (mm) | 21.8 | 20.6 | 19.4 | 14.6 | 17.0 | 15.8 | 14.6 | 13.4 | 12.2 | 11.0 | 9.9 |
| CONSTRAINING FORCE (N/mm) | 1723.0 | 790.4 | 446.7 | 326.0 | 256.6 | 211.6 | 180.0 | 156.6 | 138.6 | 124.3 | 112.7 |

TABLE 4

| | | | | | | | | | | | |
|---|---|---|---|---|---|---|---|---|---|---|---|
| θa (degree) | 80.0 | 80.0 | 80.0 | 80.0 | 80.0 | 80.0 | 80.0 | 80.0 | 80.0 | 80.0 | 80.0 |
| θb (degree) | 80.0 | 80.0 | 80.0 | 80.0 | 80.0 | 80.0 | 80.0 | 80.0 | 80.0 | 80.0 | 80.0 |
| θc (degree) | 0.0 | 3.0 | 6.0 | 9.0 | 12.0 | 15.0 | 18.0 | 21.0 | 24.0 | 27.0 | 30.0 |
| θd (degree) | 0.0 | 3.0 | 6.0 | 9.0 | 12.0 | 15.0 | 18.0 | 21.0 | 24.0 | 27.0 | 30.0 |
| Ra (mm) | 3.0 | 3.0 | 3.0 | 3.0 | 3.0 | 3.0 | 3.0 | 3.0 | 3.0 | 3.0 | 3.0 |
| Rb (mm) | 3.0 | 3.0 | 3.0 | 3.0 | 3.0 | 3.0 | 3.0 | 3.0 | 3.0 | 3.0 | 3.0 |
| Rc (mm) | 3.0 | 3.0 | 3.0 | 3.0 | 3.0 | 3.0 | 3.0 | 3.0 | 3.0 | 3.0 | 3.0 |

TABLE 4-continued

| | | | | | | | | | | | |
|---|---|---|---|---|---|---|---|---|---|---|---|
| Rd (mm) | 3.0 | 3.0 | 3.0 | 3.0 | 3.0 | 3.0 | 3.0 | 3.0 | 3.0 | 3.0 | 3.0 |
| h (mm) | 6.0 | 6.0 | 6.0 | 6.0 | 6.0 | 6.0 | 6.0 | 6.0 | 6.0 | 6.0 | 6.0 |
| BEAD BLANK LENGTH (mm) | 37.9 | 29.7 | 24.5 | 17.7 | 18.1 | 15.9 | 14.2 | 12.8 | 11.5 | 10.5 | 9.5 |
| STRAIGHT SECTION (mm) | 27.4 | 19.5 | 14.6 | 8.2 | 8.9 | 7.0 | 5.6 | 4.5 | 3.6 | 2.8 | 2.2 |
| CONSTRAINING FORCE (N/mm) | 185.3 | 182.6 | 180.0 | 177.4 | 174.9 | 172.4 | 170.0 | 167.6 | 165.2 | 162.9 | 160.6 |

TABLE 5

| | | | | | | | | | | | |
|---|---|---|---|---|---|---|---|---|---|---|---|
| h (mm) | 1.0 | 2.0 | 3.0 | 4.0 | 5.0 | 6.0 | 7.0 | 8.0 | 9.0 | 10.0 | 11.0 |
| BEAD BLANK LENGTH (mm) | 6.3 | 9.9 | 13.6 | 17.2 | 20.8 | 24.5 | 28.1 | 31.7 | 35.3 | 39.0 | 42.6 |
| STRAIGHT SECTION (mm) | −3.5 | 0.1 | 3.7 | 7.4 | 11.0 | 14.6 | 18.2 | 21.9 | 25.5 | 29.1 | 32.8 |

The variation in the subtended angle θa of the second protruding corner 3 and the subtended angle θb of the third protruding corner 4 in TABLE-2 shows the effect on the constraining force [N/mm] and the blank length of the bead W3. More precisely, the length (mm) of the straight section 15 of the blank W and the constraining force (N/mm) and length (mm) of the blank forming the bead W3 when the subtended angle θa and the subtended angle θb are increased from 30 degrees in 10 degree increments while holding the subtended angles θc and θd, the radii Ra-Rd and the height h in FIG. 1 constant.

The subtended angles θc and θd are equal.

As shown in TABLE-2 when the subtended angle θa and the subtended angle θb are in the range from 30 degrees to 60 degrees, the peripheral length and dragging force are maintained respectively to preferred values. However the length of the straight section 15 takes a minus value which means that the straight section 15 can not be formed.

In other words, it is not possible to connect the curve of the radius Rb with the curve of the radius Rc and the configuration in FIG. 1 can not be geometrically materialized. The length of the straight section 15 becomes positive only when the subtended angle θa and the subtended angle θb reach a value of 70 degrees. Under these conditions, the blank length (mm) and constraining force (N/mm) of the bead W3 also take optimal values. However the optimal values for the subtended angle θa and the subtended angle θb also vary with respect to values such as the radii Rc and Rd and the height h.

In order to materialize the geometrical configuration of FIG. 1 and ensure the straight section 15, irrespective of the value taken by the radii Rc and Rd and the height h, the lower limiting value taken by the subtended angle θa and the subtended angle θb is 30 degrees. When the subtended angle θa and the subtended angle θb exceed 90 degrees, the blank length (mm) of the bead W3 takes a minus value and the constraining force (N/mm) also undergoes a conspicuous reduction. The constraining force (N/mm) in this case is expected to be equivalent to the force on the bead in the comparative example.

The above point demonstrates that even when the radii Ra and Rb are set to relatively large values, it is preferred that the subtended angle θa and the subtended angle θb are set in the range from 30 degrees to 90 degrees in order to obtain a sufficient constraining force. Since the subtended angle θa and the subtended angle θb are acute in this range, the constraining force is large and the blank length of the bead W3 stays within a preferable range, even when the radii Ra and Rb are large. When the radii Ra and Rb are large, it is possible to prevent scraping of galvanized section when the blank W comprises metal plate with a galvanized surface.

TABLE-3 shows an effect of the variation in the radii Ra-Rd of the first protruding corner 2 second protruding corner 3, third protruding corner 4 and fourth protruding corner 5 on the blank length and the constraining force of the bead W3. More precisely, the length (mm) of the straight section 15 of the blank W, the constraining force (N/mm) and length (mm) of the blank forming the bead W3 are specified when the radii Ra-Rd are increased from 0 mm in 0.5 mm increments while holding the subtended angles θa-θd, and the height h constant in FIG. 1. The subtended angles θa-θd are equal.

In TABLE-3, when the radii Ra-Rd are in the range from 0 mm to 1.0 mm, it is thought that although an excellent constraining force (N/mm) is obtained, cracks are produced in the bead W3. Sheet metal blank is characterized by the tendency to undergo conspicuously large mechanical deterioration in response to a radius of curvature when it undergoes bending. When the radius of curvature is small, preferred molding characteristics can not be obtained. From TABLE-3, it can be seen that the radius R has a lower limiting value of 1 mm and an upper limiting value of 5 mm, while the preferred range may be defined as 2-4 mm.

From the above analysis, it can be seen that although the radius of curvature Ra-Rd of each protruding corner 2-5 varies with respect to the type or the molding of sheet metal blank, the optimal radius of curvature is considered to be within the range of 1 mm to 5 mm. In the simulation providing the figures in TABLE-2, the radii of curvature Ra-Rd were all set to the same value. However it is possible to set the radii of curvature Ra-Rd to different values. Setting the radii of curvature Ra-Rd to a suitable value makes it possible to prevent scraping of galvanized section when the blank W is sheet metal with a galvanized surface. Furthermore it is possible to obtain a preferred constraining force by selecting the radii of curvature Ra-Rd.

TABLE-4 shows an effect of the variation in the subtended angle θc of the first protruding corner 2 and the subtended angle θd of the fourth protruding corner 5 on the constraining force [N/mm] and the blank length (mm) of the bead W3. More precisely, the length (mm) of the straight section 15 of the blank W and the constraining force (N/mm)

and blank length (mm) of the bead W3 are specified when the subtended angle θc and the subtended angle θd are increased from 0 degrees in 3 degree increments while holding the subtended angles θa and θb, the radii Ra-Rd and the height h in FIG. 1 constant.

The subtended angles θc and θd are equal.

The subtended angle θc is the angle between the vertical line and the straight section 13 as shown in FIG. 1. The actual subtended angle of the first protruding corner 2 is a value obtained by adding 90 degrees to the subtended angle θc. The subtended angles θd is the angle between the vertical line and the straight section 14 as shown in FIG. 1. The actual subtended angle of the fourth protruding corner 5 is a value obtained by adding 90 degrees to the subtended angle θd.

The above fixed relationships allow the angle θc and the angle θd to be used as representative values for the subtended angles of the first protruding corner 2 and the fourth protruding corner 5 respectively.

According to TABLE-4 as the subtended angle θc and the subtended angle θd increase from 0 degrees being the lower limiting value, the blank length of the bead W3 is reduced and the constraining force decreases.

From TABLE-4, it can be seen that when the subtended angle θc and the subtended angle θexceed 30 degrees, a large reduction in the constraining force can be predicted.

Practically, the upper limiting value of the subtended angle θc and the subtended angle θd can be assumed to be 30 degrees. When the limiting value is converted to the actual subtended angle of the first protruding corner 2 and the fourth protruding corner 5, it takes a value of 90-120 degrees. Furthermore the preferred range of the subtended angle θc and the subtended angle θd is in a range from 0 degrees to 10 degrees.

The subtended angle θc and the subtended angle θd are set in response to the required constraining force.

Table 5 shows the effect of the variation in the height h of the bead W3 on the length (mm) of the straight section 15 and the blank length (mm) of the of the bead W3. More precisely, the length (mm) of the straight section 15 and the length (mm) of the blank forming the bead W3 are specified when the height h is increased from 1 mm in 1 mm increments. Although the height h affects the constraining force, it is not possible to calculate the constraining force directly from the value for the height h.

From TABLE-5, it can be seen that the length (mm) of the straight section 15 and the blank length (mm) of the bead W3 increases as the height h increases. Thus it is possible to reduce the blank length (mm) of the bead W3, in other words, the blank used for forming the bead W3 by suppressing the value for the height h.

As shown above, this invention forms protruding sections and indented sections alternatively on a bead W3. Thus appropriate settings for the subtended angles θa-θd and the radii Ra-Rd of the protruding corners 2-5 of the upper die 11 and the lower die 12 used to form the protruding and indented sections ensure a sufficient constraining force on the bead W3. Furthermore this makes it possible to prevent scraping of galvanized sections when the blank W is sheet metal with a galvanized surface.

More precisely, scraping of the galvanized surface can be prevented by setting the radii Ra-Rd to a large value. It is possible to obtain a sufficient constraining force by setting the subtended angles θa-θd to within the geometrically permissible range. In particular, it is possible to obtain a sufficient constraining force even when the radii Ra-Rb are relatively large by setting the subtended angle θa of the second protruding corner 3 and the subtended angle θb of the third protruding corner 4 to a range of 30 degrees to 90 degrees.

Furthermore the constraining force can be ensured and cracking of the bead W3 can be prevented by setting the radii of curvature Ra-Rd of the protruding corners 2-5 in a range from 1 mm to 5 mm. Furthermore in order to obtain the required constraining force, a wide range of values for the constraining force can be obtained by regulating the subtended angle of the first protruding corner 2 and the subtended angle of the fourth protruding corner 5 to a preferred range of 90-120 degrees.

It is possible to adapt to both a single-action draw forming die 20A and a double-action draw forming die 20B by selecting a height h of the horizontal section located on the inner periphery of the grip section W3 with respect to the horizontal section W5 located on the outer periphery of the grip section W3.

The contents of Tokugan 2004-376183, with a filing date of Dec. 27, 2004 in Japan, and Tokugan 2005-248915 with a filing date of Aug. 30, 2005 in Japan are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, in the above embodiment, the bead W3 comprises two alternatively disposed indented sections A, C and protruding sections B, D. However this invention is not limited to the number of indented or protruding sections. In other words, it is possible to adapt the invention to cases in which the number of indented or protruding sections differs from the above embodiment.

The embodiments of this invention in which an exclusive property or privilege is claimed are defined as follows:

What is claimed is:

1. A press molding device for press molding of a sheet blank, the sheet blank comprising a product section and a grip section surrounding the product section, the device comprising:

an upper die being provided with alternately disposed protruding corners and indented corners; and a lower die being provided with alternately disposed protruding corners and indented corners so as to mesh with the upper die;

wherein the device is configured to press mold a bead comprising grooves and tongues disposed alternately within the grip section by meshing the upper die and the lower die, wherein the device is configured to press mold the product section while gripping the bead with the upper die and the lower die;

wherein the upper die and the lower die are provided with a first protruding corner, a second protruding corner, a third protruding corner, and a fourth protruding corner disposed within the grip section from an outer periphery of the grip section towards an inner periphery thereof;

wherein the upper die comprises the first protruding corner and the third protruding corner, wherein the first protruding corner and the third protruding corner are configured to form grooves;

wherein the lower die comprises the second protruding corner and the fourth protruding corner, wherein the second protruding corner and the fourth protruding corner are configured to form tongues;

wherein a subtended angle of the first protruding corner and a subtended angle of the fourth protruding corner are greater than or equal to 90 degrees and less than or equal to 120 degrees.

2. A press molding device for press molding of a sheet blank, the sheet blank comprising a product section and a grip section surrounding the product section, the device comprising:

an upper die being provided with alternately disposed protruding corners and indented corners; and a lower die being provided with alternately disposed protruding corners and indented corners so as to mesh with the upper die;

wherein the device is configured to press mold a bead comprising grooves and tongues disposed alternately within the grip section by meshing the upper die and the lower die, wherein the device is configured to press mold the product section while gripping the bead with the upper die and the lower die;

wherein the upper die and the lower die are provided with a first protruding corner, a second protruding corner, a third protruding corner, and a fourth protruding corner disposed within the grip section from an outer periphery of the grip section towards an inner periphery thereof;

wherein the upper die comprises the first protruding corner and the third protruding corner, wherein the first protruding corner and the third protruding corner are configured to form grooves;

wherein the lower die comprises the second protruding corner and the fourth protruding corner, wherein the second protruding corner and the fourth protruding corner are configured to form tongues;

wherein the lower die comprises a first indented corner corresponding to the first protruding corner and a third indented corner corresponding to the third protruding corner, and the upper die comprises a second indented corner corresponding to the second protruding corner and a fourth indented corner corresponding to the fourth protruding corner;

wherein the grip section comprises horizontal sections respectively disposed on the inner and outer sides of the bead, the upper die comprising a horizontal face connected with the first protruding corner and a horizontal face connected with the fourth indented corner, and the lower die comprising a horizontal face connected with the first indented corner and facing the horizontal face connected with the first protruding corner and a horizontal face connected to the fourth protruding corner and facing the horizontal face connected with the fourth indented corner;

wherein the horizontal face connected to the first protruding corner is disposed at a position lower than the horizontal face connected to the fourth indented corner.

3. A press molding device for press molding of a sheet blank, the sheet blank comprising a product section and a grip section surrounding the product section, the device comprising:

an upper die being provided with alternately disposed protruding corners and indented corners; and a lower die being provided with alternately disposed protruding corners and indented corners so as to mesh with the upper die;

wherein the device is configured to press mold a bead comprising grooves and tongues disposed alternately onto the grip section by using the meshing of the upper die and the lower die; and press mold the product section while gripping the bead with the upper die and the lower die in mesh;

wherein the upper die and the lower die are provided with a first protruding corner, a second protruding corner, a third protruding corner, and a fourth protruding corner disposed from an outer periphery of the grip section towards an inner periphery thereof;

wherein the upper die comprises the first protruding corner and the third protruding corner for abutting with the grip section for forming the grooves, and the lower die comprises the second protruding corner and the fourth protruding corner for abutting with the grip section for forming the tongues, wherein the grip section comprises horizontal sections respectively disposed on the inner and outer sides of the bead, the upper die comprising a horizontal face connected with the first protruding corner and a horizontal face connected with a fourth indented corner, and the lower die comprising a horizontal face connected with a first indented corner and facing the horizontal face connected with the first protruding corner and a horizontal face connected to the fourth protruding corner and facing the horizontal face connected with the fourth indented corner; and wherein the horizontal face connected to the first protruding corner is disposed at a position lower than the horizontal face connected to the fourth indented corner.

4. The press molding device as defined in claim 3, wherein the lower die comprises the first indented corner corresponding to the first protruding corner and a third indented corner corresponding to the third protruding corner, and the upper die comprises a second indented corner corresponding to the second protruding corner and the fourth indented corner corresponding to the fourth protruding corner.

5. The press molding device as defined in claim 4, wherein the upper die comprises a flat face connecting the first protruding corner and the second indented corner, a flat face connecting the second indented corner and the third protruding corner, and a flat face connecting the third protruding corner and the fourth indented corner, and the lower die comprises a flat face connecting the first indented corner and the second protruding corner, a flat face connecting the second protruding corner and the third indented corner, and a flat face connecting the third indented corner and the fourth protruding corner.

6. The press molding device as defined in claim 3, wherein a subtended angle of the second protruding corner and a subtended angle of the third protruding corner are greater than or equal to 30 degrees and less than or equal to 90 degrees.

7. The press molding device as defined in claim 3, wherein the respective radii of the first protruding corner, the second protruding corner, the third protruding corner and the fourth protruding corner are greater than or equal to 1 millimeter and less than or equal to 5 millimeters.

8. The press molding device as defined in claim 3, wherein a subtended angle of the first protruding corner and a subtended angle of the fourth protruding corner are greater than or equal to 90 degrees and less than or equal to 120 degrees.

9. The press molding device as defined in claim 3, wherein the horizontal section on the outer side of the bead is tangent to the first indented corner and the first protruding corner which meshes with the first indented corner, while the horizontal section on the inner side of the bead is tangent to the fourth indented corner and the fourth protruding corner which meshes with the fourth indented corner.

10. A press molding method for press molding of a sheet blank, the sheet blank comprising a product section and a grip section surrounding the product section, the method comprising:

press molding a bead comprising grooves and tongues disposed alternately onto the grip section by using meshing of an upper die and a lower die, the upper die being provided with alternately disposed protruding corners and indented corners and the lower die being provided with alternately disposed protruding corners and indented corners so as to mesh with the upper die, and press molding the product section while gripping the bead with the upper die and the lower die in mesh;

wherein the upper die and the lower die are provided with a first protruding corner, a second protruding corner, a third protruding corner, and a fourth protruding corner disposed from an outer periphery of the grip section towards an inner periphery thereof;

wherein the upper die comprises the first protruding corner and the third protruding corner abutting with the grip section for forming the grooves, and the lower die comprises the second protruding corner and the fourth protruding corner abutting with the grip section for forming the tongues, wherein the grip section comprises horizontal sections respectively disposed on the inner and outer sides of the bead, the upper die comprising a horizontal face connected with the first protruding corner and a horizontal face connected with a fourth indented corner, and the lower die comprising a horizontal face connected with a first indented corner and facing the horizontal face connected with the first protruding corner and a horizontal face connected to the fourth protruding corner and facing the horizontal face connected with the fourth indented corner; and wherein the horizontal face connected to the first protruding corner is disposed at a position lower than the horizontal face connected to the fourth indented corner.

* * * * *